US008450650B2

(12) United States Patent
Findley

(10) Patent No.: US 8,450,650 B2
(45) Date of Patent: May 28, 2013

(54) IGNITER

(75) Inventor: Stephan D. Findley, Marshall, TX (US)

(73) Assignee: Atheneum, LLC, Marshall, TX (US)

( * ) Notice: Subject to any disclaimer, the term of this patent is extended or adjusted under 35 U.S.C. 154(b) by 751 days.

(21) Appl. No.: 12/614,096

(22) Filed: Nov. 6, 2009

(65) Prior Publication Data

US 2011/0108541 A1 May 12, 2011

(51) Int. Cl.
*F23Q 7/22* (2006.01)

(52) U.S. Cl.
USPC ..... 219/270; 102/202.5

(58) Field of Classification Search
USPC ..... 219/270; 102/202.8
See application file for complete search history.

(56) References Cited

U.S. PATENT DOCUMENTS

| | | | | |
|---|---|---|---|---|
| 3,754,506 | A | 8/1973 | Parker | |
| 3,971,320 | A * | 7/1976 | Lee | 102/202.9 |
| 5,044,278 | A | 9/1991 | Campbell | |
| 5,235,127 | A | 8/1993 | Findley | |
| 5,471,032 | A * | 11/1995 | Spellman et al. | 219/270 |
| 5,838,094 | A * | 11/1998 | Hanspal | 313/141 |
| 5,996,500 | A | 12/1999 | Findley | |
| 6,205,927 | B1 | 3/2001 | Findley | |
| 6,354,033 | B1 | 3/2002 | Findley | |
| 2004/0231546 | A1 | 11/2004 | Ofca | |
| 2007/0261583 | A1 | 11/2007 | Nance | |
| 2007/0261584 | A1 | 11/2007 | Nance et al. | |
| 2008/0134924 | A1 * | 6/2008 | Sawka | 102/291 |

* cited by examiner

*Primary Examiner* — Stephen W Smoot
(74) *Attorney, Agent, or Firm* — Jeffrey G. Degenfelder; Carstens & Cahoon, LLP

(57) ABSTRACT

Disclosed is an igniter. In one aspect, the igniter has one or more conductive electrodes made from a conductive plastic and is surrounded by a non-conductive plastic. A conductive sleeve made from conductive plastic can optionally surround the non-conductive plastic. A high voltage signal can be sent from one end of the electrode to the second end where an arc is formed between the second end of the electrode and a second electrode or the conductive sleeve. The arc can ignite combustible material in the vicinity, including potentially the non-conductive sleeve.

20 Claims, 3 Drawing Sheets

IGNITER

BACKGROUND OF THE INVENTION

1. Technical Field

The present invention pertains to an igniter for igniting explosives for pyrotechnic or high explosive charges.

2. Description of Related Art

As discussed in U.S. Patent Application Publication No. 2004/0231546, detonators are used to initiate various types of explosive charges from industrial to military settings. Some detonation systems utilize electrical current to initiate the explosive charge. These electric detonators typically consist of an elongated shell with an electrical ignition element at one end and an explosive base charge enclosed at the other end. External initiator leads extend through the ignition element and into the detonator interior, facing towards the base charge. A small bridge wire extends across the ends of the initiator leads and is usually covered with a small amount of explosive material. To detonate the device, electrical current is introduced across the initiator leads. The small diameter of the bridge wire creates resistance to the flow of electrical current, generating heat. If the heat exceeds a critical temperature, the explosive material reacts, initiating the explosive reaction that will ultimately cause the detonation of the base charge. Additionally, a delay element may be disposed between the ignition element and the base charge to regulate the time between the initiation of the explosive reaction and the detonation of the base charge.

The design of electric detonators utilizing the heating of a bridge wire allows low electrical current signals to be employed. This creates safety issues regarding the premature detonation of these devices. One of these issues relates to static electricity buildup. Static electricity from the environment or the individual using the detonator may build up in the initiation leads and be discharged through the bridge wire, causing premature initiation of the explosive reaction and the detonation of the base charge.

Another major safety issue involved with electric detonators concerns RF radiation from radios and cell phones. If the length of the initiator leads is a multiple of the wavelength of the RF radiation, the leads may act as antennas, causing a small current to flow through the bridge wire. This absorbed energy can cause incidental heating of the bridge wire in conventional detonators and initiate the explosive reaction. Advantages over conventional bridge wire igniters or primers are described in U.S. Pat. No. 5,235,127 and U.S. Pat. No. 6,205,927. Although such devices provide certain advantages set forth therein, there is a need for an igniter that can be easily manufactured and used in a variety of applications permitted by a flexible igniter.

SUMMARY OF THE INVENTION

The present invention is one embodiment, directed towards an igniter having a conductive electrode, a non-conductive sleeve surrounding the electrode and a conductive coaxial sleeve. In one embodiment, the igniter is flexible. In one aspect of the present invention, the igniter comprises two non-metallic electrodes in spaced relation and separated by a non-conductive coaxial sleeve that longitudinally encompasses the non-metallic electrodes.

In one embodiment, the present invention is directed towards an igniter having conductive electrodes separated by a non-conductive adhesive or non-adhesive divider. In one embodiment, one or more adhesive or non-adhesive non-conductive substrate is adhesively applied to the non-conductive divider.

Other aspects, embodiments and features of the invention will become apparent from the following detailed description of the invention when considered in conjunction with the accompanying drawings. The accompanying figures are schematic and are not intended to be drawn to scale. In the figures, each identical or substantially similar component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention. All patent applications and patents incorporated herein by reference are incorporated by reference in their entirety. In case of conflict, the present specification, including definitions, will control. The above as well as additional features and advantages of the present invention will become apparent in the following written detailed description.

BRIEF DESCRIPTION OF THE DRAWINGS

The novel features characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

Figure 1A:
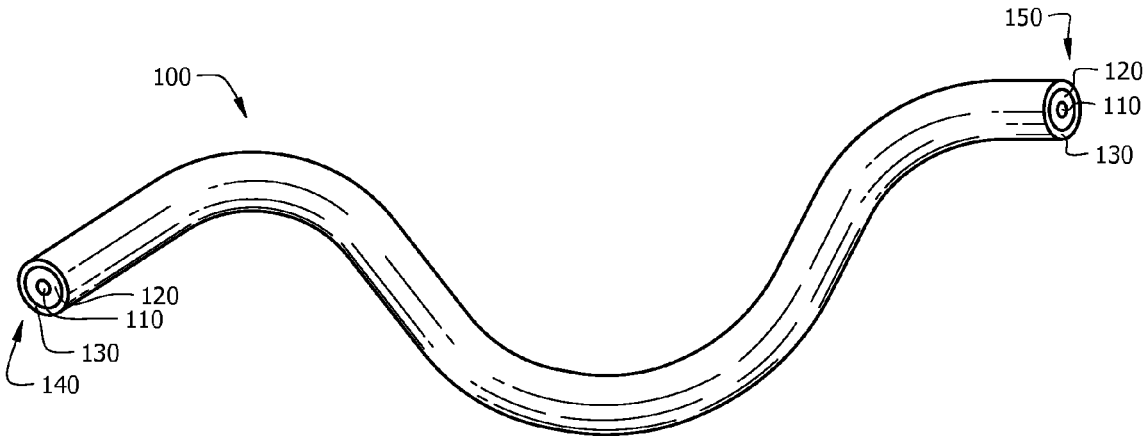
FIG. 1*a* is a perspective view of a coaxial igniter in accordance with one embodiment of the present invention.
Figure 1B:
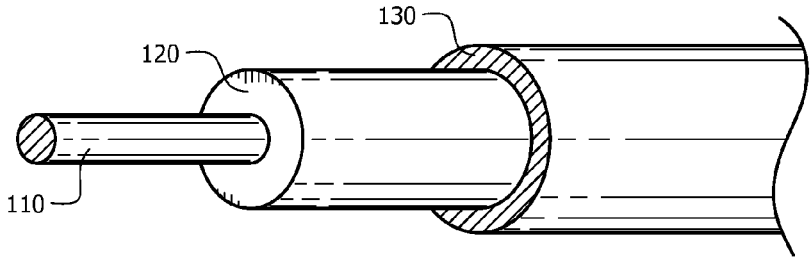
FIG. 1*b* is an exploded, partial view of the igniter depicted in FIG. 1*a;*

Referring now to the provided drawings, similar reference numerals represent the equivalent component throughout the several views of the drawings. FIG. 1*a* is a perspective view of a coaxial igniter in accordance with one embodiment of the present invention. FIG. 1*b* is an exploded partial view of the igniter depicted in FIG. 1*a*.

Referring to FIGS. 1*a* and 1*b*, a flexible igniter 100 comprises a conductive electrode 110 surrounded by a non-conductive coaxial sleeve 120 which is surrounded by a conductive coaxial sleeve 130. In the embodiment shown, the non-conductive coaxial sleeve 120 is in concentric relation with both the conductive electrode 110 and the conductive coaxial sleeve 130. The flexible igniter 100 depicted in FIGS. 1*a* and 1*b* can be advantageously manufactured by co-extrusion.

The first end 140 of the conductive electrode 110 can be adapted to be in circuit with a suitable source of a high voltage electrical signal. The source can be an electric coil type device for imposing a high voltage electric signal on the conductive electrode 110. For example, a multiple pulse electric signal having a peak voltage of 14,000 volts DC at a pulse rate of 1600 Hertz as described in U.S. Pat. No. 6,205,927, the entirety of which is hereby incorporated by reference can be used.

In one embodiment, the conductive electrode 110 comprises a conductive plastic. As used herein, a conductive plastic is one that, through compounding techniques, contains conductive fillers which, in turn, impart their conductive properties to the plastic. In some embodiments, the conductive plastics that may be used to form conducting material contain fillers that form sufficient conductive current-carrying paths through the plastic matrix to support the photovoltaic current generated by the photovoltaic device with negligible resistive losses. For example, in one embodiment the conductive plastic is 90% polypropylene and 10% carbon fiber by weight. In one embodiment, the conductive electrode 110 is non-metallic. The conductive plastic can be selected from a thermoplastic or thermosetting composition, including nylon, propylene, polycarbonate, polypropylene and ABS, and these compositions can be doped or filled with a suitable quantity of carbon, carbon fibers, metals or aluminized fiberglass, or other suitable conductive material. These doping materials provide a suitable conductivity of the electrode material which enables these electrodes to rapidly conduct the high voltage electric signal from the first end 140 of the conductive electrode 110 to the second end 150 of the conductive electrode 110.

A high voltage electronic signal sent from the first end 140 of the electrode 110 travels to the second end 150 of the electrode. Upon reaching the second end 150 of the conductive electrode 110, an arc is created across the non-conductive sleeve 120 between the conductive electrode 110 and the conductive sleeve 130. Such arc can rapidly ignite or cause combustion of the material (not shown) in the vicinity of the second end 150.

The non-conductive coaxial sleeve 120 can be constructed of substantially any electrically non-conductive material such as a non-doped thermoplastic or thermosetting material, including but not limited to nylon, polyethylene, polypropylene, acrylonitrile-butadiene-styrene (herein after "ABS"), and non-plastic materials including a glass/ceramic material such as fiberglass. The non-conductive coaxial sleeve 120 can be produced from material suitable for certain applications, such as aerospace ordnance, which require physical and chemical stability over a wider range of environmental operating conditions.

The conductive sleeve 130 can be made from the same types of materials as the conductive electrode 110. The thermoplastic or thermosetting plastic composition utilized for the conductive layers 110 130 as well as the non-conductive layer 120 can range from non-flammable to highly flammable and the flammability level can be dialed in as desired. If non-flammable material or flame retardant is used, the igniter can be re-used by removing any portion of the second end 150 changed by the arc.

Figure 2:
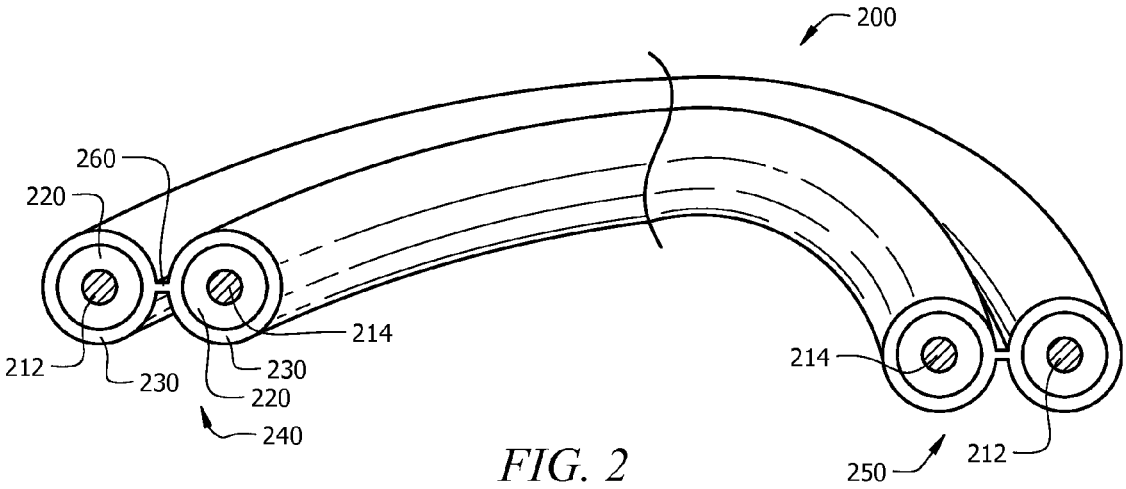
FIG. 2 is a perspective view of a separable, dual-stranded igniter in accordance with one embodiment of the present invention.

FIG. 2 is a perspective view of a separable, dual-stranded igniter in accordance with one embodiment of the present invention. Advantageously, the dual-stranded flexible igniter 200 depicted in FIG. 2 comprises two flexible igniters 100 depicted in FIG. 1 that are removably connected by a separable tear strip 260. The tear strip 260 can be scored or unscored and have a suitable thickness that permits a user to separate the first end 240 of the two igniters. Like the single stranded flexible igniter 100 depicted in FIG. 1, the dual stranded flexible igniter 200 comprises a first strand having a first conductive electrode 212 and a second strand having a second conductive electrode 214, each conductive electrode being surrounded by a non-conductive sleeve 220 and a sleeve 230. In such embodiment, the sleeve 230 can be conductive or non-conductive, and the sleeve 230 can be made of a relatively tough non-conductive material such as nylon, high density polyethylene, low-density polypropylene and a plurality of other suitable materials those having ordinary skill in the art, armed with this disclosure, would be able to ascertain. In one embodiment, the first end 240 of the first conductive electrode 212 is adapted to be in circuit with a suitable source of a high voltage electrical signal discussed above. The first end 240 of the second conductive electrode 214 can be adapted to be in circuit with a ground (not shown). The second end 250 can be placed in proximity of combustible material (not shown). Consequently, when the voltage is applied to the first electrode 212, the high voltage electric signal will rapidly move from the first end 240 of the first the electrode 212 to the second end 250 of the first electrode 212. This will create an arc between the first electrode 212 and the second electrode 214 at the second end 250 of the igniter because of the ground applied to the first end 240 of the second conductive electrode 214. In such embodiment, the sleeve 230 comprises a non-conductive material. In one embodiment, if a flammable, non-conductive material such as polypropylene or if a plurality of flammable composite materials are selected for the non-conductive sleeve 220, this arc can ignite the non-conductive material 220 at the second end 250 between the conductive electrodes 212 214.

The configuration depicted in FIG. 2 is especially advantageous in high humidity environments because there are no corrosion issues since no metal is being used in the igniter 200. Consequently, the igniter of one embodiment of the present invention is superior to metal electrode igniters and can perform better and is more reliable over time. Consequently, the present invention is superior to prior art igniters that employ metal conductors and fine metal bridge wires because such igniters are susceptible to dissimilar metal corrosion and mechanical fatigue. Further, micro-welding techniques used to assemble prior art metal based igniters are costly and are highly susceptible to wide deviations in quality.

Figure 3:
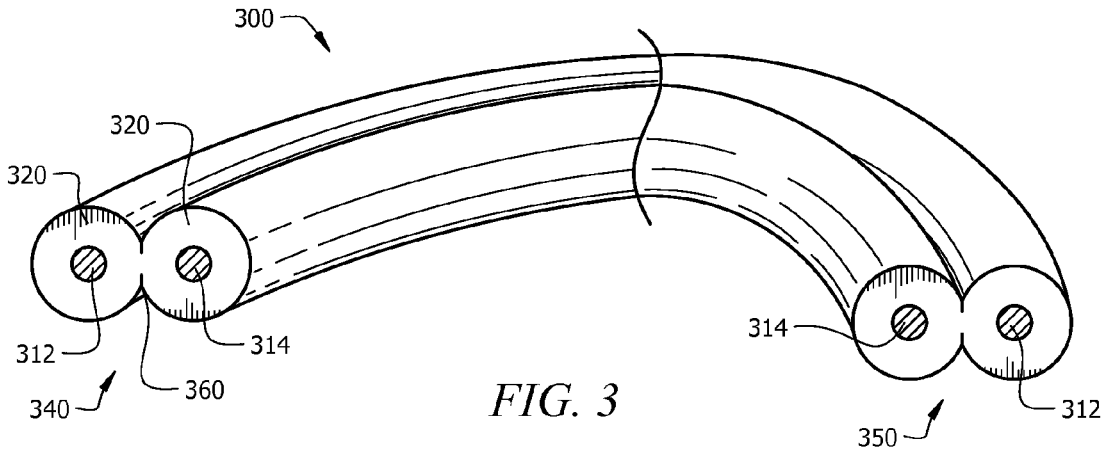
FIG. 3 is a perspective view of a separable, dual-stranded igniter in accordance with an alternative embodiment of the present invention.

FIG. 3 is a perspective view of an igniter in accordance with one embodiment of the present invention. The dual-stranded flexible igniter 300 depicted in FIG. 3 comprises two strands that are removably connected by a depression that functions as a separable tear strip. As used herein, the terms "depression" and "tear strip" are synonymous and used interchangeably to denote a weakened area that promotes separability of at least two strands. The tear strip 360 can be scored or unscored and have a suitable thickness that permits a user to separate the first end 340 of the two igniters. Like the dual stranded flexible igniter 200 depicted in FIG. 2, the dual stranded flexible igniter 300 comprises a first strand having a first conductive electrode 312 and a second strand having a second conductive electrode 314, each conductive electrode being surrounded by a non-conductive sleeve 320. Unlike the dual stranded flexible igniter 200 depicted in FIG. 2, the dual stranded flexible igniter 300 depicted in FIG. 3 does not have an outer conductive sleeve.

In one embodiment, the first end 340 of the first conductive electrode 312 is adapted to be in circuit with a suitable source of a high voltage electrical signal discussed above. The first end 340 of the second conductive electrode 314 can be optionally adapted to be in circuit with a ground (not shown). The second end 350 can be placed in proximity of combustible material (not shown). Consequently, when the voltage is applied to the first electrode 312, the high voltage electric signal will rapidly move from the first end 340 of the first the electrode to the second end 350 of the first electrode 312. This will create an arc between the first electrode 312 and the second electrode 314 at the second end 350 of the igniter. In one embodiment, this arc can ignite the non-combustible material (not shown) at the second end 350 between the conductive electrodes 312 314. The distance between the ends of the conductive electrodes 312 314 at the second end 350 can be adjusted to control the minimum energy required to make the arc.

Such configuration advantageously eliminates the need for a fine bridge wire apparatus which is susceptible to various external energetic stimuli that can cause accidental initiation. Additionally, energetic materials deposited on fine bridge wire igniters are friction sensitive. This embodiment eliminates the inherent risk of an accidental friction caused initiation.

Figure 4:
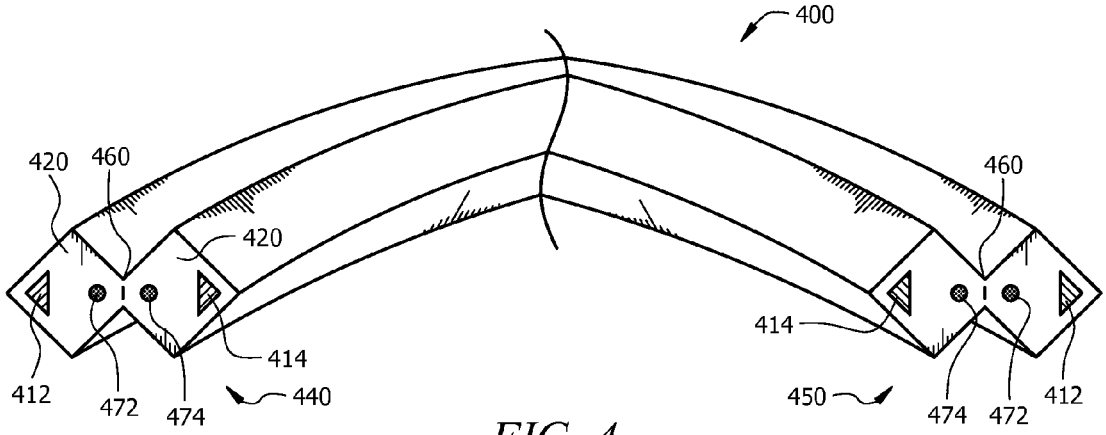
FIG. 4 is a perspective view of a separable, dual-stranded igniter having fiber optic filaments in accordance with one embodiment of the present invention.

FIG. 4 is a perspective view of a separable, dual-stranded igniter having fiber optic filaments in accordance with one embodiment of the present invention. The dual-stranded flexible igniter 400 depicted in FIG. 4 comprises two strands that are removably connected by a separable tear strip 460. The tear strip 460 can be scored or unscored and have a suitable thickness that permits a user to separate the first end 440 of the two igniters. Like the dual stranded flexible igniter 300 depicted in FIG. 3, the dual stranded flexible igniter 400 comprises a first strand having a first conductive electrode 412 and a second strand having a second conductive electrode 414, each conductive electrode being surrounded by a non-conductive sleeve 420. Although, FIG. 4 depicts the electrodes 412 414 as in eccentric relation to the non-conductive sleeve 420, those having ordinary skill in the art armed with this disclosure will understand various other geometric configurations can be used in accordance with the spirit and slope of the present invention.

In one embodiment, the first end 440 of the first conductive electrode 412 is adapted to be in circuit with a suitable source of a high voltage electrical signal discussed above. The first end 440 of the second conductive electrode 414 can be adapted to be in circuit with a ground (not shown). The second end 450 can be placed in proximity of combustible material (not shown). Consequently, when the voltage is applied to the first electrode 412, the high voltage electric signal will rapidly move from the first end 440 of the first electrode 412 to the second end 450 of the first electrode 412. This will create an arc between the first electrode 412 and the second electrode 414 at the second end 450 of the igniter. In one embodiment, if flammable material is use for the non-conductive sleeve 420, this arc can ignite the non-conductive material 420 at the second end 450 between the conductive electrodes 412 414.

In one embodiment, each strand further comprises a fiber optic filament 472 474 encapsulated within each strand. In one embodiment, an interrogation signal, such as light, can be routed through the fiber optic filament 472 at the first end 440 of the igniter 400. The signal will travel to the second end 450 of the igniter and can be reflected into the fiber optic filament 474 at the second end 450 of the igniter. The amount of reflectance can then be measured at the first end 440 of the fiber optic filament 474. The amount of reflectance can be used to determine whether a detonation has occurred. If there is relatively little remittance, then the second end 450 of the igniter has likely detonated because the light remittance is significantly diminished once the second end 450 has been in contact with a detonation due to damage to the second end 450 of the fiber optic strands 472, 474. Conversely, if there is relatively high remittance, the second end 450 of the igniter 400 has likely not detonated. Consequently, the use of fiber optic filaments 472 474 can be used in conjunction with a suitable interrogation signal to determine and/or confirm whether a detonation is occurring, has occurred, or has not occurred. In one embodiment, the fiber optic filaments 472 474 are co-extruded along with the other materials during manufacturing of the igniter 400.

Prior to this invention, fine bridge wire igniters used a small interrogation impulse of electricity to poll an igniter. If the fine bridge wire igniter had suffered a mechanical cross sectional capacitance due to dissimilar metal corrosion or mechanical fatigue, then the small interrogation impulse could inadvertently cause ignition of the compromised bridge wire igniter. Additionally, false positive bridge wire intactness can occur through infiltration of moisture mixed with residual combustion products from a fired igniter causing a firing system to report that igniters are intact when they have already been fired.

Figure 5:
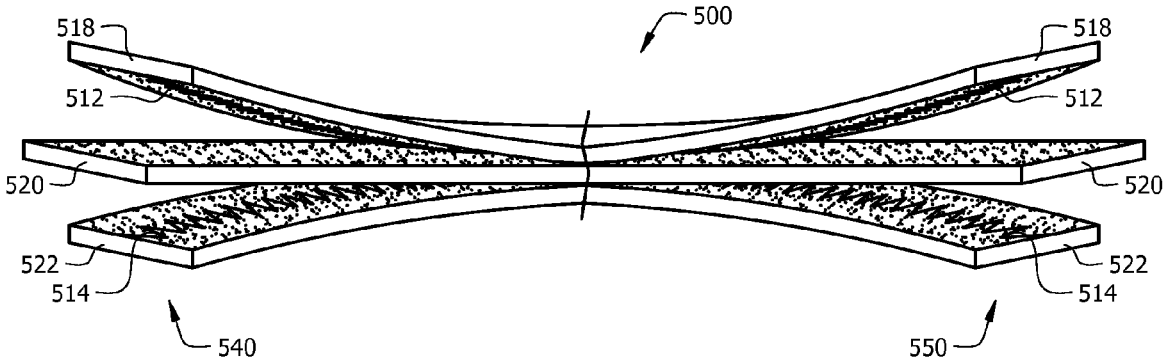
FIG. 5 is an exploded, perspective view of a separable, dual-stranded igniter in accordance with an alternative embodiment of the present invention.

FIG. 5 is an exploded perspective view of an igniter in accordance with one embodiment of the present invention. In the embodiment shown in FIG. 5, the igniter 500 comprises a first conductive electrode 512 disposed on a first non-conductive substrate 518 and a second conductive electrode 514 disposed on a second non-conductive substrate 522. A non-conductive divider 520 is disposed between the conductive electrodes 512 514.

In one embodiment, one or both substrates 518 522 comprise an adhesive cellophane, similar to SCOTCH tape. Other suitable non-conductive material such as a non-doped thermoplastic or thermosetting material, including but not limited to nylon, polyethylene, polypropylene, ABS, and non-plastic materials including a glass/ceramic material such as fiberglass can also be used. The substrates 518 522 and the divider 520 can be made of flammable or non-flammable composite materials. Like the other embodiments disclosed herein, the flammability level can be dialed into any of these layers (e.g., 518 520 522) as desired.

In one embodiment, the conductive electrodes 512 514 are adhered to the respective substrate 518 522 by the adhesives on the respective substrate 518 522. In one embodiment (not shown), the divide 520 comprises an adhesive on one or both sides, and one or both of the electrodes 512 514 are adhered onto opposite sides of the non-conductive divider 520. The interface between the divider 520 and either substrate 518 522 can be peelable. The electrodes 512 514 can be the same type of conductive plastic described above. In one embodiment, the electrodes 512 514 can be formed from a solid metal, such as copper, aluminum or steel. Metals can be applied by methods known in the art including vapor deposition. In one embodiment, the electrodes 512 514 are off-set from one another to adjust the distance to control the voltage necessary to create the arc.

In one embodiment, the divider 520 can be color coded to denote the voltage required to create an arc at the second end 550. In one embodiment, the divider comprises a non-conductive material such as a non-doped thermoplastic or thermosetting material, including but not limited to nylon, polyethylene, polypropylene, acrylonitrile-butadiene-styrene (herein after "ABS"), and non-plastic materials including a glass/ceramic material such as fiberglass. Although only a single conductive electrode is depicted as being disposed between the substrate and the divider, in one embodiment, one or more electrodes can be disposed between a divider and substrate. The igniter can be used by merely snipping off the damaged portion of the second end.

In one embodiment, a third conductive electrode (not shown) can be placed parallel to the conductive electrode 514 between the divider 520 and the substrate 522. A high voltage can be applied to both the third electrode (not shown) and conductive electrode 514 thereby creating two arcs at the second end 550 of the igniter. Such dual firing circuits can be used to provide additional reliability in the event that one of the electrodes should fail to transmit the impulse.

The igniters disclosed herein can be utilized in gas generators, for example hot gas generators, cold gas generators, and hybrid generators. Additional areas of application are ignition devices for pyrotechnical protective systems, for example airbags and belt tensioning devices. Furthermore, such igniters can be used for escape slides in aircraft, airbags in cars, in commercial mining and blasting as well as for pyrotechnic devices such as commercial fireworks, and military pyrotechnic devices. The igniters can also be used in household wiring applications involving low voltage direct current.

Various embodiments of the igniter of the present invention advantageously eliminate bridge wires and the disadvantages caused by bridge wire devices including the ultra sensitive igniter composition which covers the bridge wire and is friction sensitive. The present invention can provide users with a continuous length of an igniter that can advantageously be cut to the desired length in the field. Another advantage of various embodiments of the present invention is that a user can cut off the burnt end of a fired igniter and reuse the remaining length again to fire another explosive charge. Further, a user can insert the igniter into a small diameter access hole in an explosive charge after placing the explosive charge to provide safer handling, arming and transport of explosive charges. In one embodiment, the invention advantageously, through use of an interrogation signal via the fiber optic elements, provides information regarding the status of a detonation.

Those having ordinary skill in the art, armed with this disclosure, will recognize that various combinations of embodiments disclosed herein can be made. For example, the fiber optic filament disclosed in FIG. 4 can be used in embodiments disclosed in the other figures. Similarly, the number geometric configurations, and distances between the enumerated elements including, but not limited to, of the strands, the conductive electrodes, non-conductive sleeves, non-conductive substrates, and tear strips can be modified by those having ordinary skill in the art, armed with this disclosure.

While the invention has been described with respect to a preferred embodiment, other embodiments are possible as one of ordinary skill in the art will recognize that one can modify the particulars of the embodiment without straying from the inventive concept.

I claim:

1. An igniter comprising:
- a flexible first conductive electrode;
- a first non-conductive coaxial sleeve surrounding said first conductive electrode; and
- a first conductive coaxial sleeve surrounding said first non-conductive coaxial sleeve, wherein said igniter is flexible along its entire length.

2. The igniter of claim 1 wherein said first conductive electrode comprises a conductive plastic.

3. The igniter of claim 1 wherein said first non-conductive coaxial sleeve comprises a non-conductive plastic.

4. The igniter of claim 1 wherein said first conductive coaxial sleeve comprises a conductive plastic.

5. The igniter of claim 1 wherein said first conductive coaxial sleeve is in concentric relation to said first conductive electrode.

6. The igniter of claim 1 wherein said first conductive electrode and said first non-conductive coaxial sleeve comprise substantially the same length.

7. The igniter of claim 1 wherein said first conductive coaxial sleeve or said first non-conductive coaxial sleeve is in eccentric relation to said first conductive electrode.

8. The igniter of claim 1 further comprising a fiber optic filament disposed within said first non-conductive coaxial sleeve.

9. The igniter of claim 1 further comprising:
- a first strand comprising said first conductive electrode, said first non-conductive coaxial sleeve, and said first conductive coaxial sleeve;
- a second strand comprising:
- a second conductive electrode.

10. The igniter of claim 9 further comprising a tear strip between said first conductive electrode and said second conductive electrode.

11. The igniter of claim 1 wherein said first non-conductive coaxial sleeve is flammable.

12. An igniter comprising:
- a first non-metallic electrode;
- a second non-metallic electrode in spaced relation to said first non-metallic electrode;
- a single non-conductive coaxial sleeve surrounding both said first non-metallic electrode and said second non-metallic electrode.

13. The igniter of claim 12 wherein said igniter comprises a tear strip between said first and second non-metallic electrodes.

14. The igniter of claim 12 wherein said non-conductive coaxial sleeve is flammable.

15. The igniter of claim 12 further comprising at least one fiber optic filament disposed within said non-conductive coaxial sleeve.

16. An igniter comprising:
- a first conductive electrode;
- a second conductive electrode; and
- a non-conductive divider disposed between said first conductive electrode and said second conductive electrode;

wherein said igniter is flexible along its entire length.

17. The igniter of claim 16 wherein said first conductive electrode or said second conductive electrode is disposed on an adhesive substrate.

18. The igniter of claim 17 wherein said adhesive substrate is detachably connected to a second substrate.

19. The igniter of claim 16 further comprising a third conductive electrode in spaced relation to said first conductive electrode.

20. The igniter of claim 16 further comprising at least one fiber optic filament disposed upon said non-conductive divider.

* * * * *